US005578775A

United States Patent [19]

Ito

[11] Patent Number: 5,578,775

[45] Date of Patent: Nov. 26, 1996

[54] WIRE FOR MUSICAL INSTRUMENT STRING

[76] Inventor: Keisuke Ito, 1-105, Misoracho 1-ban, Otsu-shi, Shiga 520-02, Japan

[21] Appl. No.: 175,382

[22] PCT Filed: Jul. 8, 1991

[86] PCT No.: PCT/JP91/00911

§ 371 Date: Jan. 10, 1994

§ 102(e) Date: Jan. 10, 1994

[87] PCT Pub. No.: W093/01585

PCT Pub. Date: Jan. 21, 1993

[51] Int. Cl.[6] ..... G10D 3/00

[52] U.S. Cl. ..... 84/297 S; 84/199; 428/364; 428/371

[58] Field of Search ..... 84/297 S, 199; 228/173.5; 428/364, 371

[56] References Cited

U.S. PATENT DOCUMENTS

| | | | |
|---|---|---|---|
| 2,710,557 | 6/1955 | Sundt | 84/297 S |
| 4,063,674 | 12/1977 | Stone et al. | 84/297 S |

FOREIGN PATENT DOCUMENTS

| | | |
|---|---|---|
| 2-9581 | 8/1927 | Japan . |
| 52-25243 | 7/1977 | Japan . |
| 55-57893 | 4/1980 | Japan . |
| 58-40756 | 9/1983 | Japan . |
| 59-39744 | 11/1984 | Japan . |
| 62-49339 | 10/1987 | Japan . |
| 3-62092 | 3/1991 | Japan . |

*Primary Examiner*—Cassandra C. Spyrou
*Attorney, Agent, or Firm*—Armstrong, Westerman, Hattori, McLeland & Naughton

[57] ABSTRACT

A string for use on musical instrument is made of a core wire composed of long filaments, sheathed with a thick mantle of a precious metal such as gold, silver, platinum, palladium, copper, or the like, or of other metal (5) having excellent ductility, or of an alloy of these metals, or of a synthetic resin or ceramic. It becomes possible to change the density per unit length, thus to enable the adjustment of sound quality and the attenuation rate, and the selection of the basic vibration frequency. It also becomes possible to adjust the tensile strength of the string, thus to enable the selection of the tensile strength and the density in accordance with the type of the musical instrument which is strung and the type (number) of the string. It also becomes possible to maintain the sound quality of the wound wire for bass strings for a long term, and to take easily countermeasures against abrasion with a partial hardening treatment. Furthermore asset value is created and a colorful, attractive appearance is provided by using precious metals for the material.

18 Claims, 2 Drawing Sheets

WIRE FOR MUSICAL INSTRUMENT STRING

BACKGROUND OF THE INVENTION

1. Field of the Invention

This invention relates to a string for use on musical instruments which makes it possible to use precious metals known as materials having ductility, such as gold, silver, platinum, copper etc., and also resins and other materials having ductility, for the string used on pianos and stringed instruments such as guitars and violins, etc.

2. Description of the Prior Art

Strings used on musical instruments are classified into three types: strings which are struck, strings which are plucked and strings which are bowed. Strings made of steel, steel wire wound with annealed copper wire, synthetic resin, sheep gut, etc. have been used for musical instruments. Strings for musical instruments are required to keep strong tension and a high degree of stability for a long period of time due to the nature of strings being strung and tuned up. In addition, strings which stretch by bowing, or break by plucking or striking cannot be reliably used on musical instruments.

Thus it was obvious that, even if metals having excellent ductility, such as gold, silver or platinum, etc. were drawn into wire, such metal wire would immediately stretch when tensile force was applied to it, and could not be used as a string for musical instruments; while copper, a kind of precious metal, although it cannot be used as a core wire for the same reason as the other metals already mentioned, it is widely used as a means of obtaining appropriate harmonic sounds by winding it around steel wire as softened annealed copper wire with heat treatment given.

On the other hand, musical tones resonated by precious metals such as gold, silver, etc. are generally accepted as beautiful ones, which is verified by their use in some wind instruments as alloys.

The purpose of this invention is to produce strings, core wires and winding wires for musical instruments using precious metals such as gold, silver, platinum, etc. which were previously considered inappropriate for the material of the string for musical instruments, and also to produce musical instrument strings using copper as the core wire, and moreover, to open the way to the use of such materials as high-polymer resins etc., which are considered inconsistent or impossible to be tuned up, as the string for musical instruments.

SUMMARY OF THE INVENTION

The string for use on musical instruments of this invention is characterized in that one or more long filaments of carbon fiber, silicon carbide fiber or ceramic fiber having high tensile strength, or one or more super-fine metal wires, or a combination of these long filaments and superfine metal wires, are used as the core wire.

The string for use on musical instruments of this invention is also characterized in that said core wire is sheathed with (i.e., impregnated within) a thick mantle of a precious metal such as gold, silver, platinum, palladium, copper or the like, or of some other metal having excellent ductility, or of an alloy of these metals.

Moreover, the string for musical instruments of this invention is characterized in that said core wire is sheathed with (i.e., impregnated within) a thick mantle of synthetic resin or ceramic.

In addition, the string for use on musical instruments of this invention is characterized in that abrasion-resistance treatment is given to one or more of the sections of the musical instrument string which are struck, plucked or bowed, or which support the string. Furthermore, the string for use on musical instruments of this invention is characterized in that the wire material manufactured as described above is wound around the wire of the same material or around steel wire.

A string having high tensile strength and an extremely small amount of stretching can be obtained by composing the string for use on musical instruments of this invention from the core wire which contains one or more long filaments of carbon fiber, super-fine metal wires, silicon carbide fiber or ceramic fiber having high tensile strength. It is possible to use this core wire for the string for use on musical instruments simply by winding wire around the core wire, however by sheathing the exterior of the core wire with gold, silver, platinum, palladium or an alloy containing these precious metals, it becomes possible to newly introduce the tones which have been brought only by things having mostly flat surfaces such as wind instruments, coins, bells, gongs, etc. to stringed instruments. At the same time, the string for musical instruments have been considered to be only expendable supplies; however, using precious metals for the material of the string creates an asset value to the string in accordance with the value of the precious metals. Furthermore, the color and the luster of the string made of gold or other metals provide us an unconventionally beautiful appearance.

Because the string for use on musical instruments of this invention uses a core wire having such high tensile strength, it makes it possible to use such materials as resins, which cannot have been used for the string for musical instruments because of their high ductility, and as ceramics etc. which cannot have been used because of their brittleness.

When the string for musical instruments of this invention is strung on an instrument, the core wire bears the greater part of the tensile force acting on the string. On the other hand, the sound emitted by the vibration of the string with plucking, striking or bowing is extremely close to the tone of gold, silver, etc. which share the greater part of the cross-sectional area and the mass of the string. Therefore, it becomes possible for substances which have not been the materials for a string to be applied to a musical instrument string. In addition, it becomes possible for gold, silver, etc. to be used in the winding wire in which annealed copper has been mainly used, because ductility, the defect of gold, silver, etc. is eliminated. Thus it becomes possible to enjoy the variations of musical tones and colors.

When the exterior surface of the core wire of the string for musical instruments is sheathed with gold, silver, or other metal having a low level of hardness and a high level of ductility, it is preferable to give abrasion-resistance treatment to the sections of the string which support the string, which are struck, plucked and bowed, and the sections which contact with frets, because these sections are especially easy to abrade. For example, gold having a high level of surface hardness can be obtained by placing boron powder in contact with only the appropriate sections of the gold alloy containing 1 to 10%, preferably 5%, of chrome, iron or copper and then by giving heat treatment, when gold is used for the ductile metal. The level of the surface hardness can also be raised by such methods as phosphate coating, vapor plating, flame coating or ion plating etc., when the base material is an alloy.

In addition, the repeated vibration of the string increases the friction coefficient between the core wire and the winding wire, and the friction between these two wires loses a part of the vibration energy generated in striking or plucking the string, so that the sound volume decreases, and also the noise generated by the friction will cause a distorted or unclear musical tone, when a metal having a high ductility is used for the winding wire or the core wire. As a countermeasure to the above, the two wires can be secured by fusing the contact surface or the entire surface of the winding wire or the core wire with gold solder, gold or silver brazing and then by winding while giving heat treatment or by giving heat treatment after winding.

DETAILED DESCRIPTION OF THE PREFERRED EMBODIMENT OF THE INVENTION

The following is a more detailed explanation of this invention in reference to the accompanying drawings.

Figure 1:
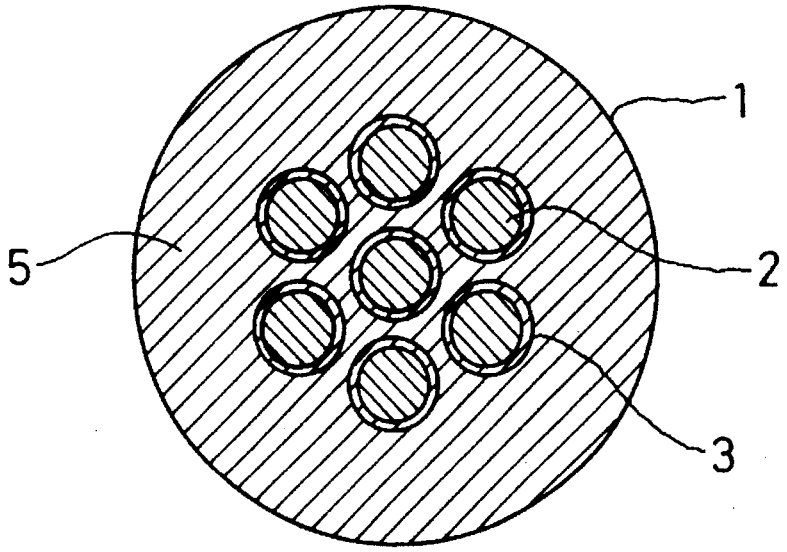
FIG. 1 is an enlarged cross section showing one embodiment of the string for use on musical instruments of this invention.

In FIG. 1, a metallic thin film 3 is plated onto the surface of the long filaments of carbon fiber 2. The exterior surface of the bundle of multiple said long filaments is sheathed with (embedded within) a thick mantle of ductile metal 5 having excellent ductility, but having been considered unsuitable for fabricating the string for musical instruments.

The tensile strength of the carbon fiber 2 used in this invention is approximately 720 kg/m, and the diameter of the single filament is approximately 5.5 μm, thus the carbon fiber is quite suitable for the core wire of a musical instrument string. The heat-resistant temperature of the carbon fiber 2 is approximately 450° C. in air and approximately 2500° C. in a vacuum or in inert gas. On the other hand, because the wettability of the carbon fiber is poor even if it is directly submerged in molten metal, the surface of the carbon fiber 2 is coated with copper and nickel with approximately 0.2 μm in thickness respectively by an electrolytic plating method. The metallic coating is an effective method not only for improving wettability but for preventing deterioration, because the surface of the single filament of the carbon fiber would deteriorate at the temperature more than 400° C. in air.

10,698 strands of the above nickel-plated carbon fiber are cut to 100 cm in length, and then both ends are bound by gold brazing for 1 cm at each end. Next the fiber is extended on the roll having a 15 mm diameter and a 0.3 mm deep groove in the circumferential direction, and then wound onto the ceramic roll positioned in parallel with said roll. Then, the end of the bundle of fibers is inserted into the capillary tube of an exit diameter 900 μm with two diametrically opposite pores of 550 μm diameter, corresponding to the core in a melt. The ceramic roll is secured at the bottom of the capillary tube so that it can revolve, and both rolls are moved to the position above the crucible and immerged in molten 18 karat gold. The 18 karat gold comprised of 75% gold, 15% silver, 7% copper and 3% nickel is in a molten state at the temperature of approximately 980° C., with an inert gas atmosphere maintained by using nitrogen gas in the crucible. The wire and the like of 900 μm in diameter with characteristics equivalent to #15•½ piano wire is fabricated through the above procedure.

Figure 2:
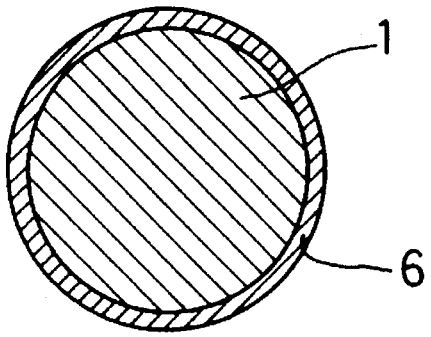
FIG. 2 is an enlarged cross section showing the wire given abrasion-resistance treatment.

In FIG. 2, an abrasion-resistant layer 6 is formed on the surface of said wire 1 for 5 cm in length by a boron hardening method. The method of hardening a surface by wrapping iron or some other material with boron powder and then by giving heat treatment is a commonly known technique. This method is also effective for a copper-nickel alloy, and it is easy to harden only the section to be struck of the musical instrument string.

Figure 3:
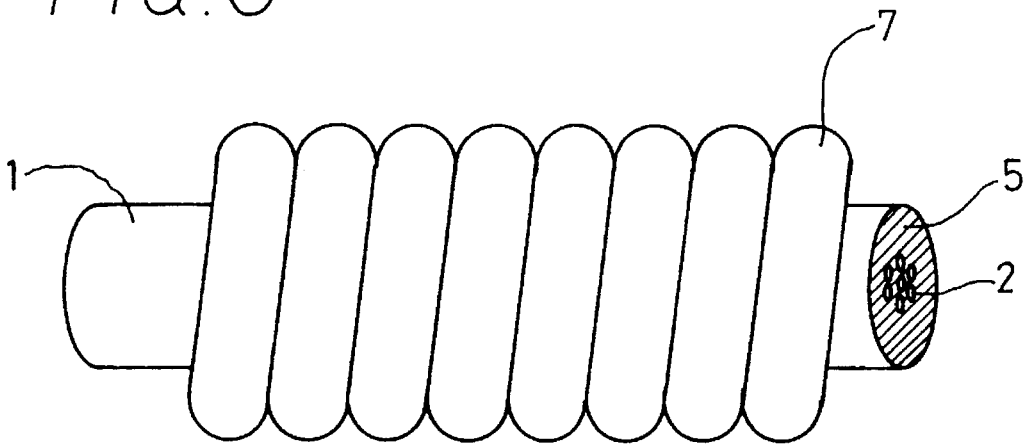
FIG. 3 is an enlarged perspective view showing the winding wire of the string for use on musical instruments of this invention.
Figure 4:
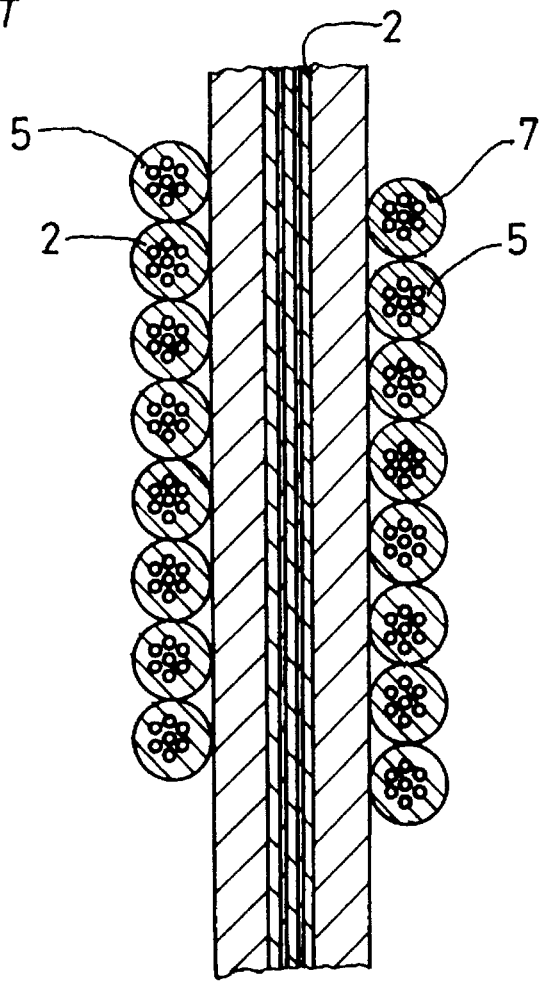
FIG. 4 is an enlarged cross section showing one embodiment of the configuration in which the winding wire of the string for use on musical instruments of this invention is wound around the core wire.

FIG. 3 and 4 show that the core wire 1 is wound with the wire 7 having the same construction but being thinner than the core wire 1. It is possible to take the same method as described above in order to harden the surface of the section to be struck of the wound string.

The following is a relational equation for the musical tone of the string for musical instruments.

$$f_0 = \frac{1}{2l}\sqrt{\frac{T}{P}}$$

$f_0$ indicates the vibration frequency, l indicates the length of the string, T indicates the tension and P indicates the mass per unit length in the above equation. The fundamental vibrations of the vibration frequency $f_0$ determined by the above equation and other upper vibrations of the sound emitted by a musical instrument string all exist as harmonic vibrations. It is clearly shown that the basic vibration frequency (the vibration frequency in a normal mode) of the musical instrument string is in direct proportion to the square root of the tension, and in inverse proportion to the length of the string and to the square root of the linear density.

In this invention, it is possible to freely change the mass (density) per unit length indicated by P in the equation above, and the fluctuation of the quantity of the long filaments comprising the string can meet the degree of the tension required by the musical instrument. This means that basic vibration frequencies in far wider range can be selected in comparison to the conventional string for use on musical instruments.

Furthermore, the density of the material used for the winding wire is closer to the density of the original composing materials exclusive of carbon fiber for the wound bass string shown in FIG. 3, because the tensile strength of the winding wire is not required to be as high as that of the core wire and is enough to be equivalent to that of common annealed copper wire, thus the quantity of the long filaments of the carbon fiber can be greatly reduced in comparison to the quantity of the core wire, and as a result, it becomes possible to increase the mass per unit area of precious metals such as gold, silver, etc. or of the alloy of such metals, or of the high-polymer resin, etc.

In addition, it is also possible to fabricate laterally wound wire by using as its core wire not only the carbon fiber described in this embodiment, but also some other long filaments or super-fine metal wires having both toughness and strength sufficient to embody the winding of a wire. As one example, it is possible to sheath a bundle of superfine metal wires in the Fe-C-Si-Mn series having a tensile strength of 515 kg/m, a wire diameter of 20 μm, and a heat-resistant temperature of 450° C. with a thick mantle of a gold solder of gold-tin (20%) alloy having a melting temperature of 260° C. and of gold-silicon (3.15%) alloy having a melting temperature of 370° C. It is possible to fabricate a wound wire using either the musical instrument string of this invention or a conventional steel wire for the core wire, or an organic material for the core wire, and furthermore, it is also possible to use the string of this invention for the core wire and a conventional annealed copper wire for the winding wire. In any of these cases, it is possible to selectively fabricate products while maintaining the necessary level of tensile strength and taking into consideration such various factors as the adjustment of the wire density, the vibration attenuation rate of the material used, the type of musical instrument on which the string is to be strung, and furthermore, the harmonization during the performance of the musical instrument.

Capability for Commercial Application

The string for use on musical instruments and the wound wire of this invention make it possible to use various metals, in particular precious metals such as gold, silver, platinum, etc., and high-polymer resins, etc., which were previously considered unsuitable for the materials of the musical instrument string due to their ductility. The strings for use on musical instruments which have been fabricated of steel, annealed copper, sheep gut, silk, nylon, etc. must bear the tensile strength required in stringing musical instruments evenly to the cross-sectional surface area. Therefore, the materials of the strings have been limited. In the string for use on musical instruments of this invention, the core wire bears the greater part of the tensile strength and the greater part of the mass per cross-sectional surface area is made of a thick mantle of a precious metal such as gold, silver, platinum or the like, a synthetic resin, or ceramic on said core wire. Furthermore, far wider range of the density of the strings for musical instruments can be selected, because the density of the core wire can be adjusted by compounding carbon fibers and superfine metal wires such as tungsten, etc. In addition, besides being able to enjoy the special musical tone inherent to the string sheathed with a thick mantle of a precious metal, the string can increase the asset value in accordance with the value of the used precious metal without being treated as expendable supplies as conventional, and furthermore, it becomes possible to enjoy the variations of musical sound quality and the the color in the surface of the string.

I claim:

1. A wire for a string for use on musical instruments, comprising one or more filaments and a precious metal, the one or more filaments being impregnated within the precious metal.

2. A wire according to claim 1, wherein said one or more filaments are selected from the group consisting of carbon fiber, silicon carbide fiber, ceramic fiber and metal wire.

3. A wire according to claim 1, wherein said precious metal is selected from the group consisting of gold, silver, platinum, palladium, and copper.

4. A wire according to claim 1, wherein said wire is provided with one or more abrasion resistant sections which are more resistant to abrasion than other portions of said wire.

5. A wire according to claim 1 wherein the core wire and wound wire are fused together.

6. A wire according to claim 1, wherein said one or more filaments comprise a metallic film coated thereon.

7. A wire for a musical instrument string comprising one or more filaments impregnated within a material selected from the group consisting of precious metals, alloys thereof, and synthetic resin, said material being present in an amount which occupies a greater part of a cross-sectional area and a mass of the string.

8. A wire for a musical instrument string comprising one or more filaments impregnated within ceramic, said ceramic being present in an amount which occupies a greater part of a cross-sectional area and a mass of the string.

9. A wire for a musical instrument string according to claim 7 or claim 8, wherein said filaments are selected from the group consisting of carbon fiber, silicon carbide fiber, ceramic fiber and super-fine metal wire.

10. A wire for a musical instrument string according to claim 7, wherein said precious metal is selected from the group consisting of gold, silver, platinum, palladium and copper.

11. A musical instrument string comprising the wire for a musical instrument string as defined in one of claims 7, 8 or 10 as a core wire, or a winding wire provided around the core wire.

12. A musical instrument string according to claim 11, comprising an abrasion resistant section on one or more parts of the musical instrument string.

13. A musical instrument string according to claim 11, wherein the core wire and the winding wire are fused together.

14. A wire for a musical instrument string according to claim 7, wherein said one or more filaments comprise a metallic film coated thereon.

15. A string for use on a stringed instrument comprising: a first wire including one or more filaments and a precious metal, the one or more filaments being impregnated within the precious metal; and a core wire; said first wire being wound around said core wire.

16. The string according to claim 15, wherein said core wire includes one or more filaments and a precious metal, the one or more filaments being impregnated within the precious metal.

17. The string according to claim 15, wherein the core wire comprises steel.

18. The string according to claim 15, wherein the core wire comprises an organic material.

* * * * *